US008475983B2

(12) United States Patent
Yu et al.

(10) Patent No.: US 8,475,983 B2
(45) **Date of Patent: *Jul. 2, 2013**

(54) IMAGING MEMBERS HAVING A CHEMICAL RESISTIVE OVERCOAT LAYER

(75) Inventors: Robert C. U. Yu, Webster, NY (US); Yuhua Tong, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 282 days.

This patent is subject to a terminal disclaimer.

(21) Appl. No.: 12/828,138

(22) Filed: Jun. 30, 2010

(65) Prior Publication Data

US 2012/0003575 A1 Jan. 5, 2012

(51) Int. Cl.
*G03G 5/147* (2006.01)

(52) U.S. Cl.
USPC ..... 430/66; 430/58.8; 430/59.6; 399/159

(58) Field of Classification Search
USPC ..... 430/58.8, 59.6, 66; 399/159
See application file for complete search history.

(56) References Cited

U.S. PATENT DOCUMENTS

| | | | |
|---|---|---|---|
| 3,121,006 | A | 2/1964 | Middleton et al. |
| 3,820,989 | A | 6/1974 | Rule et al. |
| 3,837,851 | A | 9/1974 | Shattuck et al. |
| 3,895,944 | A | 7/1975 | Wiedemann et al. |
| 4,150,987 | A | 4/1979 | Anderson et al. |
| 4,245,021 | A | 1/1981 | Kazami et al. |
| 4,256,821 | A | 3/1981 | Enomoto et al. |
| 4,265,990 | A | 5/1981 | Stolka et al. |
| 4,278,746 | A | 7/1981 | Goto et al. |
| 4,286,033 | A | 8/1981 | Neyhart et al. |
| 4,291,110 | A | 9/1981 | Lee |
| 4,297,426 | A | 10/1981 | Sakai et al. |
| 4,315,982 | A | 2/1982 | Ishikawa et al. |
| 4,338,387 | A | 7/1982 | Hewitt |
| 4,338,388 | A | 7/1982 | Sakai et al. |
| 4,385,106 | A | 5/1983 | Sakai |
| 4,387,147 | A | 6/1983 | Sakai |
| 4,399,207 | A | 8/1983 | Sakai et al. |
| 4,399,208 | A | 8/1983 | Takasu et al. |
| 4,587,189 | A | 5/1986 | Hor et al. |
| 4,654,284 | A | 3/1987 | Yu et al. |
| 4,664,995 | A | 5/1987 | Horgan et al. |
| 4,988,597 | A | 1/1991 | Spiewak et al. |
| 5,021,309 | A | 6/1991 | Yu |

(Continued)

FOREIGN PATENT DOCUMENTS

JP 2000-162810 * 6/2000

OTHER PUBLICATIONS

Diamond, Handbook of Imaging Materials, Marcel Dekker, 1991, p. 398-399.*
Translation of JP 2000-162810 published Jun. 2000.*

*Primary Examiner* — Peter Vajda
(74) *Attorney, Agent, or Firm* — Pillsbury Winthrop Shaw Pittman LLP

(57) ABSTRACT

The presently disclosed embodiments are directed to imaging members used in electrostatography. More particularly, the embodiments pertain to electrophotographic imaging members which have an added-on protective overcoat layer formulated to comprise of a novel A-B diblock copolymer comprising two segmental blocks of a bisphenol polycarbonate and an organic acid terminal which provides chemical vapor contaminant resistive property. The overcoat layer may further be formulated to include small quantity of charge transport compound. The present embodiments provide superior copy printout quality.

18 Claims, 2 Drawing Sheets

U.S. PATENT DOCUMENTS

| | | | | |
|---|---|---|---|---|
| 5,069,993 | A | 12/1991 | Robinette et al. | |
| 5,244,762 | A | 9/1993 | Spiewak et al. | |
| 5,697,024 | A | 12/1997 | Mishra | |
| 5,703,487 | A | 12/1997 | Mishra | |
| 5,756,245 | A | 5/1998 | Esteghamatian et al. | |
| 5,919,590 | A | 7/1999 | Yu et al. | |
| 6,008,653 | A | 12/1999 | Popovic et al. | |
| 6,119,536 | A | 9/2000 | Popovic et al. | |
| 6,124,514 | A | 9/2000 | Emmrich et al. | |
| 6,150,824 | A | 11/2000 | Mishra et al. | |
| 6,214,514 | B1 | 4/2001 | Evans et al. | |
| 6,408,152 | B1 * | 6/2002 | Kitamura et al. | 399/159 |
| 6,528,226 | B1 | 3/2003 | Yu et al. | |
| 6,756,169 | B2 | 6/2004 | Lin et al. | |
| 6,933,089 | B2 | 8/2005 | Horgan et al. | |
| 7,018,756 | B2 | 3/2006 | Pai et al. | |
| 7,033,714 | B2 | 4/2006 | Horgan et al. | |
| 2007/0087276 | A1 * | 4/2007 | Qi et al. | 430/58.7 |
| 2007/0099101 | A1 * | 5/2007 | Horgan et al. | 430/58.75 |
| 2007/0287083 | A1 * | 12/2007 | Gondoh et al. | 430/58.35 |
| 2008/0014516 | A1 * | 1/2008 | Wu et al. | 430/58.2 |

* cited by examiner

IMAGING MEMBERS HAVING A CHEMICAL RESISTIVE OVERCOAT LAYER

BACKGROUND

The presently disclosed embodiments are directed to imaging members used in electrostatography. More particularly, the embodiments are pertaining to electrophotographic imaging member which has improved function by the inclusion of a protective overcoating layer prepared to comprise of a novel polycarbonate that has chemical contaminant resistive property to preserve copy printout quality as well as extend the imaging member's service life in the field. The present disclosure relates to all types of electrophotographic imaging members used in electrophotography.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Electrostatographic imaging members are well known in the art. Typical electrostatographic imaging members include, for example: (1) electrophotographic imaging member (photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring member which is used to remove the toner images from a photoreceptor surface and then transfer the very images onto a receiving paper. Generally, these imaging members comprise at least a supporting substrate and at least one imaging layer comprising a thermoplastic polymeric matrix material. In an electrophotographic imaging member or photoreceptor, the photoconductive imaging layer may comprise only a single photoconductive layer or multiple of layers such as a combination of a charge generating layer and one or more charge transport layer(s). In an electroreceptor, the imaging layer is a dielectric imaging layer.

Electrostatographic imaging members can have a number of distinctively different configurations. For example, they can comprise a flexible member, such as a flexible scroll or a belt containing a flexible substrate. Since typical flexible electrostatographic imaging members exhibit spontaneous upward imaging member curling after completion of solution coating the outermost exposed imaging layer, an anticurl back coating is therefore required to be applied to back side of the flexible substrate support to counteract/balance the curl and provide the desirable imaging member flatness. Alternatively, the electrostatographic imaging members can also be a rigid member, such as those utilizing a rigid substrate support drum. For these drum imaging members, having a thick rigid cylindrical supporting substrate bearing the imaging layer(s), there is no exhibition of the curl-up problem, and thus, there is no need for an anticurl back coating layer.

Although the scope of the present disclosure covers the preparation of all types of flexible electrostatographic imaging members in either a rigid drum design or a flexible belt configuration, for reasons of simplicity, the embodiments and discussion following hereinafter will be focused solely on and represented by electrophotgraphic imaging members in the flexible belt configuration.

Electrophotographic flexible belt imaging members may include a photoconductive layer including a single layer or composite layers. The flexible belt electrophotographic imaging members may be seamless or seamed belts; and seamed belts are usually formed by cutting a rectangular sheet from a web, overlapping opposite ends, and welding the overlapped ends together to form a welded seam. The typical negatively charged electrophotographic imaging member belts include a top outermost charge transport layer and a charge generating layer on one side of a supporting substrate layer and an anticurl back coating coated onto the opposite side of the substrate layer. By comparison, a typical electrographic imaging member belt does, however, have a more simple material structure; it includes a dielectric imaging layer on one side of a supporting substrate and an anti-curl back coating on the opposite side of the substrate to render flatness. Since typical negatively-charged flexible electrophotographic imaging members exhibit undesirable upward imaging member curling after completion of coating the top outermost charge transport layer, an anticurl back coating, applied to the backside, is required to balance the curl. Thus, the application of anticurl back coating is key to provide the appropriate imaging member with desirable flatness.

One type of composite photoconductive layer used in xerography is illustrated in U.S. Pat. No. 4,265,990 which describes a negatively-charged photosensitive member having at least two electrically operative layers. One layer comprises a photoconductive layer which is capable of photogenerating holes and injecting the photogenerated holes into a contiguous charge transport layer.

Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge generating layer (CGL) is sandwiched between the outermost exposed charge transport layer (CTL) and the electrically conducting layer, the outer surface of the CTL is charged negatively and the conductive layer is charged positively. The CGL then should be capable of generating electron hole pair when exposed image wise and inject only the holes through the CTL. In the alternate case when the CTL is sandwiched between the CGL and the conductive layer, the surface of the top outermost CGL is charged positively while conductive layer is charged negatively and the holes are injected through from the top CGL to the CTL. The CTL should be able to transport the holes with as little trapping of charge as possible. In a typical flexible imaging member web like photoreceptor, the conductive layer may be a thin coating of metal on a flexible substrate support layer.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on photoreceptors. For example, the numerous layers used in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, an optional blocking layer, an optional adhesive layer, a charge generating layer, a CTL and a conductive ground strip layer adjacent to one edge of the imaging layers, and an optional overcoat layer adjacent to another edge of the imaging layers. Such a photoreceptor usually further comprises an anticurl back coating layer on the side of the conductive layer/substrate support opposite the side carrying the blocking layer, adhesive layer, charge generating layer, CTL and other layers.

Typical negatively-charged imaging member belts, such as flexible photoreceptor belt designs, are made of multiple layers comprising a flexible supporting substrate, a conductive ground plane, a charge blocking layer, an optional adhesive layer, a charge generating layer (CGL), and a charge transport layer (CTL). The CTL is usually the last layer to be coated to become the outermost exposed layer and is applied by solution coating then followed by drying the wet applied coating at elevated temperatures of about 115° C., and finally cooling it down to ambient room temperature of about 25° C. When a production web stock of several thousand feet of coated multilayered photoreceptor material is obtained after finishing the CTL coating through drying/cooling process, upward curling of the multilayered photoreceptor is observed.

This upward curling is a consequence of thermal contraction mismatch between the CTL and the substrate support. Since the CTL in a typical photoreceptor device has a coefficient of thermal contraction approximately 3.7 times greater than that of the flexible substrate support, the CTL exhibits a larger dimensional shrinkage than that of the substrate support as the imaging member web stock (after through elevated temperature heating/drying process) as it cools down to ambient room temperature. This dimensional contraction mismatch results in tension strain built-up in the CTL, at this instant, is pulling the imaging member web stock upward to exhibit curling. If unrestrained at this point, the imaging member web stock will spontaneously curl upwardly into a 1.5-inch roll. To offset the curling, an anticurl back coating is applied to the backside of the flexible substrate support, opposite to the side having the charge transport layer, and render the imaging member web stock with desired flatness.

One layer of the flexible imaging member belt, say for example the top outermost exposed CTL in particular of a negatively charge imaging member, is constantly subjected to and suffer from the machine operational conditions, such as exposure to high surface friction interactions and extensive cycling. Such harsh conditions lead to wearing away and susceptibility of surface scratching of the CTL which otherwise adversely affect machine performance. Another imaging member functional problem associated with the CTL is its propensity to give rise to early development of surface filming due its high surface energy; CTL surface filming is undesirable because it does pre-maturely cause degradation of copy printout quality. Moreover, the outermost exposed CTL is also been found to exhibit early onset of surface cracking, as consequence of repetition of bending stress belt cyclic fatiguing, airborne chemical species exposure, and direct solvent contact, under a normal machine belt functioning condition. CTL cracking is a serious mechanical failure since the cracks do manifest themselves into defects in print-out copies. All these imaging member layers failures are major issues remained to be resolved, because they pre-maturely cut short the functional life of an imaging member and prevent it from reaching the belt life target; early imaging member functional failure does thereby require its frequent costly replacement in the field.

A number of current flexible electrophotographic imaging member belts are multilayered photoreceptor belts that, in a negative charging system, comprise a substrate support, an electrically conductive layer, an optional charge blocking layer, an optional adhesive layer, a CGL, a CTL, and an optional anticurl back coating at the opposite side of the substrate support to render flatness. In such an imaging member belt design, the CTL is therefore the top outermost exposed layer. In a typical machine design, a flexible imaging member belt is mounted over and around a belt support module comprising numbers of belt support rollers, such that the top outermost CTL is exposed to all electrophotographic imaging subsystems interactions and charging devices chemical emission attack. Under normal machine electrophotographic imaging and cleaning operating conditions, the top exposed CTL surface of the flexible imaging member belt is constantly subjected to physical/mechanical/electrical/chemical species interactions, such as for example, the mechanical sliding actions of cleaning blade and cleaning brush, electrical charging devices corona effluents exposure, developer components, image formation toner particles, hard carrier particles, debris and loose $CaCO_3$ particles from receiving paper, and the like during dynamic belt cyclic motion. These interactions against the surface of the CTL have been found to cause surface scratching, abrasion, and rapid CTL surface wear; in some instances, the CTL wears away by as much as 10 micrometers after approximately 20,000 dynamic belt imaging cycles. Excessive CTL wear is a serious problem because it causes significant change in the charged field potential and adversely impacts copy printout quality. Another consequence of CTL wear is the decrease of CTL thickness alters the equilibrium of the balancing forces between the CTL and the anti-curl back coating and impacts imaging member belt flatness. The reduction of the CTL by wear causes the imaging member belt to curl downward at both edges. Edge curling in the belt is an important issue because it changes the distance between the belt surface and the charging device(s), causing non-uniform surface charging density which manifests itself as a "smile" print defect on paper copies. Such a print defect is characterized by lower intensity of print-images at the locations over both belt edges. The susceptibility of the CTL surface to scratches (caused by interaction against developer carrier beads and the hard $CaCO_3$ particles and debris from paper) has also been identified as a major imaging member belt functional failure since these scratches do manifest themselves as print defects in paper copies.

Moreover, chemical contaminants exposure/interaction of the outermost exposed CTL, during electrophotographic imaging process in the field, has also been found to negatively affect the imaging member function. For example, exposure to the vapor amine species (from ammonia) emitted from common house cleaning agents have been seen to interact with the imaging member charge transport layer, causing material degradation to promote pre-mature onset of charge transport layer cracking and exacerbation of wear failure which severely cut short the functional life of the imaging member. In one particular instant, amine vapor impact on copy printout quality degradation has recently been seen when pre-printed papers (papers having pre-printed images which employed amine agents catalyzed UV cured ink) are used by customers for subsequent addition of xerographic images over the pre-printed paper blank spaces; that is the accumulation of amine residues deposition onto the imaging member charge transport layer surface, after repeatedly making contact with receiving papers during xerographic imaging process, is found to cause ghosting image defects print-out in the output copies. Since ghosting image defects in the output copies are unacceptable print quality failures, so it does require frequent costly imaging member replacement in the field. With all these issues and failures described above, therefore there is an urgent need to resolve these issues and extend the service life of the imaging member in the field. In particular, by the formulation of a charge transport layer that is resistive to amine specific effect to resolve the current preprinted paper ghosting image defects print out problem.

Relevant prior arts to the present disclosure are collectively summarized for reference and presented in the following:

In U.S. Pat. No. 5,069,993, an exposed layer in an electrophotographic imaging member is provided with increase resistance to stress cracking and reduced coefficient of surface friction, without adverse effects on optical clarity and electrical performance. The layer contains a polymethylsiloxane copolymer and an inactive film forming resin binder. Various specific film forming resins for the anti-curl layer and adhesion promoters are disclosed.

U.S. Pat. No. 5,021,309 shows an electrophotographic imaging device, with material for an exposed anti-curl layer has organic fillers dispersed therein. The fillers provide coefficient of surface contact friction reduction, increased wear resistance, and improved adhesion of the anti-curl layer, without adversely affecting the optical and mechanical properties of the imaging member.

U.S. Pat. No. 5,919,590 shows An electrostatographic imaging member comprising a supporting substrate having an electrically conductive layer, at least one imaging layer, an anti-curl layer, an optional ground strip layer and an optional overcoat layer, the anti-curl layer including a film forming polycarbonate binder, an optional adhesion promoter, and optional dispersed particles selected from the group consisting of inorganic particles, organic particles, and mixtures thereof.

In U.S. Pat. No. 4,654,284 an electrophotographic imaging member is disclosed comprising a flexible support substrate layer having an anti-curl layer, the anti-curl layer comprising a film forming binder, crystalline particles dispersed in the film forming binder and a reaction product of a bifunctional chemical coupling agent with both the binder and the crystalline particles. The use of VITEL PE 100 in the anti-curl layer is described.

In U.S. Pat. No. 6,528,226 a process for preparing an imaging member is disclosed that includes applying an organic layer to an imaging member substrate, treating the organic layer and/or a backside of the substrate with a corona discharge effluent, and applying an overcoat layer to the organic layer and/or an anticurl back coating to the backside of the substrate.

The above prior art disclosures show that, while attempts to resolve CTL failures described above have been successful with providing a solution, often times the success is negated due to the creation of another set of problems. Therefore, there is an urgent need to provide improved imaging members that have mechanically robust outer layers to effect service life extension but without causing the introduction of other undesirable problems.

Thus, flexible electrophotographic imaging members (comprising a supporting substrate, having a conductive surface on one side, coated over with at least one photoconductive CTL layer and coated on the other side of the supporting substrate with a anticurl back coating) used in the negative charging system do still exhibit deficiencies which are undesirable in advanced automatic, cyclic electrophotographic imaging copiers, duplicators, and printers. While the above mentioned electrophotographic imaging members may be suitable or limited for their intended purposes, further improvement on these imaging members are desirable and urgently needed. For example, there continues to be a need for improvements in such systems, particularly for an imaging member belt that includes a mechanical robust, filming-free, and scratch/wear and chemical resistant top outermost exposed layer to sufficiently maintain proper belt function to meet extended imaging life target even in larger printing apparatuses. Therefore, according to the aspects illustrated hereinafter, there is provided a protective overcoat layer which is added-onto the CTL of the imaging member to address the shortcomings and provide effective resolution to all the issues associated to the traditional CTL discussed above.

SUMMARY

According to embodiments illustrated herein, there is provided an imaging member comprising: a substrate; a charge generating layer disposed on the substrate; at least one charge transport layer disposed on the charge generating layer; and an overcoat layer disposed on the charge transport layer, wherein the overcoat layer comprises a film forming and optically clear A-B diblock copolymer comprising two segmental blocks of a bisphenol polycarbonate and an organic acid capable of providing protection against amine species contaminants.

In embodiments, there is provided an imaging member comprising: a substrate; a charge generating layer disposed on the substrate; at least one charge transport layer disposed on the charge generating layer; and an overcoat layer disposed on the charge transport layer, wherein the overcoat layer comprises a film forming and optically clear A-B diblock copolymer comprising two segmental blocks of a bisphenol A polycarbonate ($C_{16}H_{14}O_3$) and a phthalic acid.

In yet further embodiments, there is provided an image forming apparatus for forming images on a recording medium comprising: a) an imaging member having a charge retentive-surface for receiving an electrostatic latent image thereon, wherein the imaging member comprises a substrate; a charge generating layer disposed on the substrate; at least one charge transport layer disposed on the charge generating layer; and an overcoat layer disposed on the charge transport layer, wherein the overcoat layer comprises a film forming and optically clear A-B diblock copolymer comprising two segmental blocks of a bisphenol polycarbonate and an organic acid capable of providing protection against amine species contaminants; b) a development component for applying a developer material to the charge-retentive surface to develop the electrostatic latent image to form a developed image on the charge-retentive surface; c) a transfer component for transferring the developed image from the charge-retentive surface to a copy substrate; and d) a fusing component for fusing the developed image to the copy substrate.

BRIEF DESCRIPTION OF THE DRAWINGS

For a better understanding of the present disclosure, reference may be made to the accompanying figures.

DETAILED DESCRIPTION OF DRAWING

In the following description, reference is made to the accompanying drawings, which form a part hereof and which illustrate several embodiments of the present disclosure. It is understood that other embodiments may be utilized and structural and operational changes may be made without departure from the scope of the present disclosure.

Figure 1:
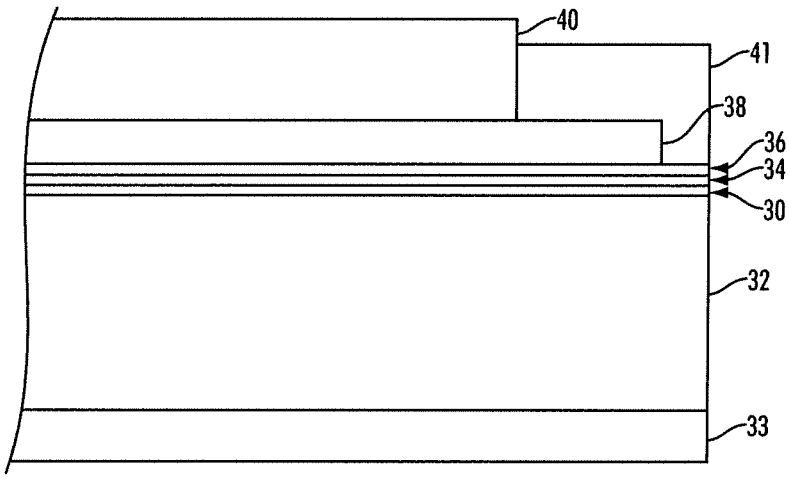
FIG. 1 a schematic cross-sectional view of a conventional flexible multilayered electrophotographic imaging member having an outermost exposed CTL.

The conventional prior art, negatively charged, flexible multilayered electrophotographic imaging member, having a top outermost exposed CTL, is illustrated in FIG. 1. The substrate 32 has an optional conductive layer 30. An optional hole blocking layer 34 can be applied over the conductive layer 30, and then followed up with an optional adhesive layer 36. The charge generating layer (CGL) 38 is located above the layers 36, 34, 30, and 32 but below the top outermost CTL 40. An optional ground strip layer 41 operatively connects the CGL 38 and the CTL 40 to the conductive layer 30 to effect electrical continuity. An anti-curl back layer 33 is usually the last layer to be applied onto the side of the substrate 32 opposite from the electrically active layers to render the imaging member flat.

Figure 2:
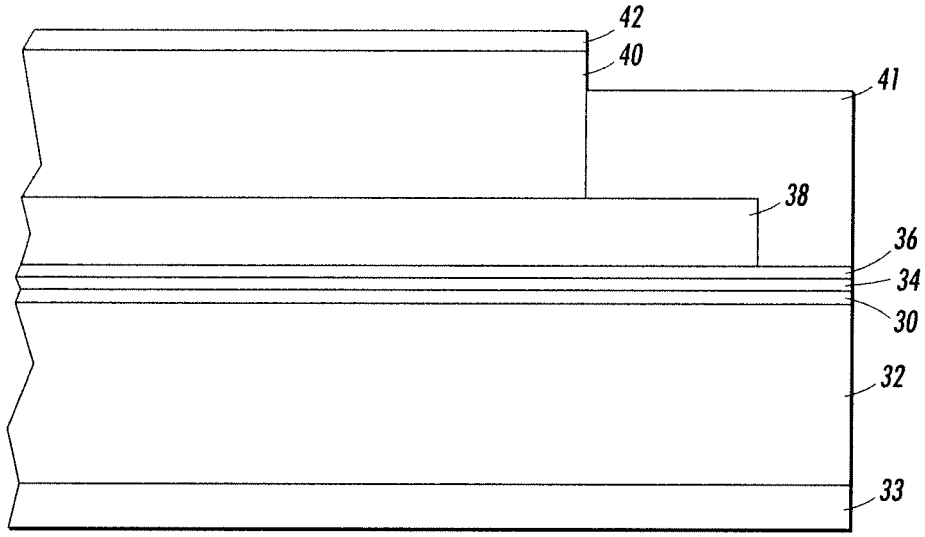
FIG. 2 is a schematic cross-sectional view of a flexible multilayered electrophotographic imaging member comprising an overcoat layer prepared according to an embodiment of the present disclosure.

In a negatively charged flexible multilayered electrophotographic imaging member embodiment of present disclosure shown in FIG. 2, the CTL of imaging the member in FIG. 1 is coated over with a protective overcoat layer 42 of the present disclosure.

Figure 3:
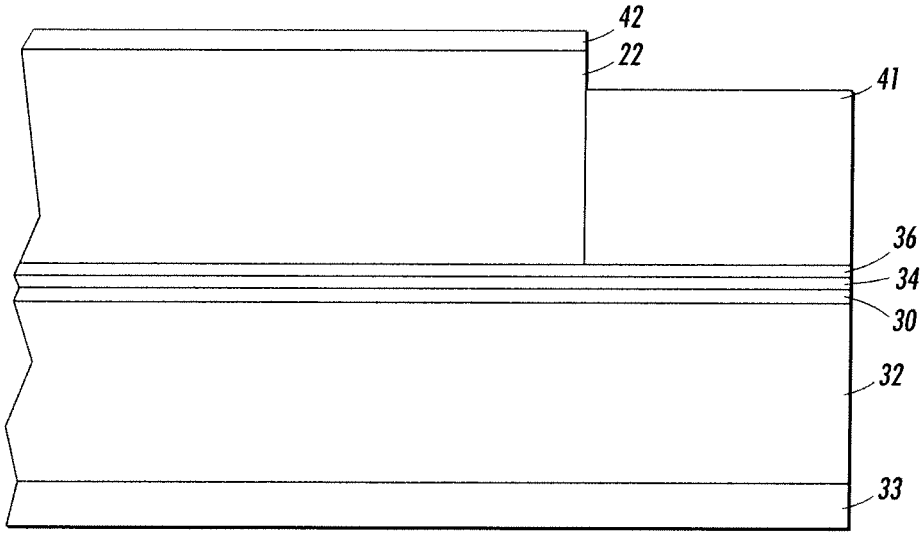
FIG. 3 is a schematic cross-sectional view of another flexible multilayered electrophotographic imaging member having a simplified single layer CTL/CGL and containing the overcoat layer prepared according to another embodiment of the present disclosure.

In another negatively charged flexible multilayered electrophotographic imaging member embodiment of this disclosure illustrated in FIG. 3, the disclosed overcoat layer 42 is applied over the top of a structurally simplified imaging member in which a single imaging layer formulated to possess dual charge generating and charge transporting capacities is used to substitute both the CGL and the CTL.

In all these embodiments, the CTL of the imaging members is covered and protected with the added-on outermost overcoat layer 42 which is formulated and prepared according to the material formulation and process of the present disclosure to provide effective CTL protection against failures and extending the imaging members functional life in the field.

There are, in various exemplary embodiments, disclosing at present the process and formulations for extending the functional life of a negatively charged flexible multilayered electrophotographic imaging member through the inclusion/addition of a protective overcoat layer added-on to the CTL. The process and formulations relate generally to the creation of a mechanically robust and chemical resistive overcoat that is designed to: (1) impart quenching/neutralization effect against chemical contaminant attack; (2) produce abrasion/wear/scratch/cracking life improvement; and (3) have absolute optical clarity for image quality/sharpness improvement in the print out copies. The imaging member thus prepared according to the present disclosure does thereby extend its service life under normal machine functioning conditions in the field.

In the example of one specific electrophotographic imaging member, the overcoat layer 42 of the present disclosure, applied directly over the CTL, is formulated to comprise a novel film forming A-B diblock copolymer. The copolymer is derived by modifying the bisphenol A polycarbonate poly(4,4'-isopropylidene diphenyl carbonate) to include a phthalic acid containing segmental block B at the terminal of the bisphenol A polycarbonate back bone. Therefore, the A-B diblock copolymer is comprising of a bisphenol A polycarbonate segment block A and a phthalic acid containing segment block B, having a general molecular structure shown in Formula (I) below:

Formula (I)

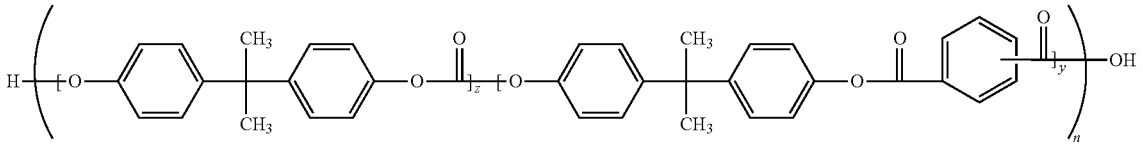

Block (A) Block (B)

In another electrophotographic imaging member example, the overcoat layer 42 of this disclosure is also formulated to comprise the film forming A-B diblock copolymer of a bisphenol A polycarbonate poly(4,4'-isopropylidene diphenyl carbonate) block A and a phthalic acid containing segmental block B at the terminal of bisphenol A polycarbonate back bone. However, the similar A-B diblock copolymer of the bisphenol A polycarbonate does have a slightly different general molecular structure shown in the following Formula (II):

Formula (II)

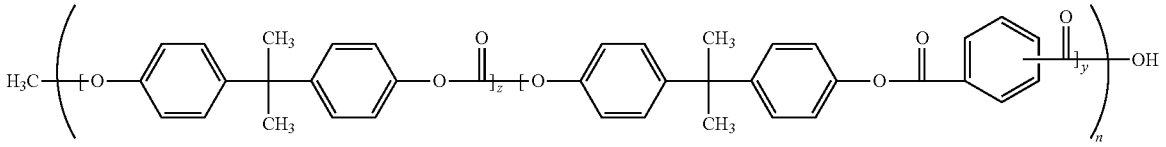

Block (A) Block (B)

In the above formulas, z represents the number of bisphenol A repeating units in block A of from about 9 to about 18, y is number of repeating phthalic acid block B of from about 1 to about 2, and n is the degree of polymerization. The degree of polymerization, n, is between about 20 and about 80 of the diblock copolymer having molecular weight between about 100,000 and about 200,000.

In reference to the negatively charged conventional prior art flexible multilayered electrophotographic imaging member of the illustrated in FIG. 1, the substrate 32 has an optional conductive layer 30. An optional hole blocking layer 34 can also be applied, as well as an optional adhesive layer 36. The CGL 38 is located between the adhesive layer 36 and the CTL 40. An optional ground strip layer 41 operatively connects the CGL 38 and the CTL 40 to the conductive layer 30, and an optional overcoat layer 42. An anticurl back coating 33 is applied to the side of the substrate 32 opposite from the electrically active layers to render imaging member flatness.

Other layers of the imaging member may include, for example, an optional ground strip layer 28, applied to one edge of the imaging member to promote electrical continuity with the conductive layer 30 through the hole blocking layer 34. An anticurl back coating layer 33 is formed on the backside of the support substrate 32 to render omaging member flatness. A conductive ground plane, which is typically a thin metallic layer, for example a 10 nanometer thick titanium coating, may be deposited over the substrate 32 by vacuum deposition or sputtering process. The layers 34, 36, 38, 40 and 42 may be separately and sequentially deposited, on to the surface of conductive ground plane 30 of substrate 32, as wet coating layer of solutions comprising a solvent, with each layer being dried before deposition of the next. Anticurl back coating 33 is also solution coated, but is applied to the back side (the side opposite to all the other layers) of substrate 32, to render imaging member flatness.

The Substrate

The photoreceptor support substrate 32 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The substrate 32 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate 32 the substrate may have a number of many different configurations, such as, for example, a plate, a drum, a scroll, an endless flexible belt, and the like. In one embodiment, the substrate is in the form of a seamed flexible belt.

The thickness of the substrate 32 depends on numerous factors, including flexibility, mechanical performance, and economic considerations. The thickness of the support substrate 32 may range from about 50 micrometers to about 3,000 micrometers. In embodiments of flexible photoreceptor belt preparation, the thickness of substrate 32 is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers.

An exemplary substrate support 32 is not soluble in any of the solvents used in each coating layer solution, is optically transparent, and is thermally stable up to a high temperature of about 150° C. A typical substrate support 32 used for imaging member fabrication has a thermal contraction coefficient ranging from about $1\times10^{-5}$/° C. to about $3\times10^{-5}$/° C. and a Young's Modulus of from about $5\times10^{-5}$ psi ($3.5\times10^{-4}$ Kg/cm$^2$) to about $7\times10^{-5}$ psi ($4.9\times10^{-4}$ Kg/cm$^2$).

The Conductive Layer

The conductive ground plane layer 30 may vary in thickness depending on the optical transparency and flexibility desired for the electrophotographic imaging member. When a photoreceptor flexible belt is desired, the thickness of the conductive layer 30 on the support substrate 32, for example, a titanium and/or zirconium conductive layer produced by a sputtered deposition process, typically ranges from about 2 nanometers to about 75 nanometers to enable adequate light transmission for proper back erase, and in embodiments from about 10 nanometers to about 20 nanometers for an optimum combination of electrical conductivity, flexibility, and light transmission. Generally, for rear erase exposure, a conductive layer light transparency of at least about 15 percent is desirable. The conductive layer need not be limited to metals. The conductive layer 30 may be an electrically conductive metal layer which may be formed, for example, on the substrate by any suitable coating technique, such as a vacuum depositing or sputtering technique. Typical metals suitable for use as conductive layer 30 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface thereof can perform the function of an electrically conductive layer and a separate electrical conductive layer may be omitted. Other examples of conductive layers may be combinations of materials such as conductive indium tin oxide as a transparent layer for light having a wavelength from about 4000 Angstroms to about 9000 Angstroms or a conductive carbon black dispersed in a plastic binder as an opaque conductive layer.

The illustrated embodiment will be described in terms of a substrate layer 10 comprising an insulating material including inorganic or organic polymeric materials, such as, MYLAR with a ground plane layer 30 comprising an electrically conductive material, such as titanium or titanium/zirconium, coating over the substrate layer 32.

The Hole Blocking Layer

A hole blocking layer 34 may then be applied to the substrate 32 or to the layer 30, where present. Any suitable positive charge (hole) blocking layer capable of forming an effective barrier to the injection of holes from the adjacent conductive layer 30 into the photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl) methyl diethoxysilane which has the formula $[H_2N(CH_2)_4]CH_3Si(OC_{H3})_2$, and (gamma-aminopropyl)methyl diethoxysilane, which has the formula $[H_2N(CH_2)_3]CH_{33}Si(OCH_3)_2$, and combinations thereof, as disclosed, for example, in U.S. Pat. Nos. 4,338,387; 4,286,033; and 4,291,110, incorporated herein by reference in their entireties. A preferred hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly(2-hydroxyethyl methacrylate) blended with the parent polymer poly(2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties.

The hole blocking layer 34 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of from about 0.05:100 to about 5:100 is satisfactory for spray coating.

The Adhesive Interface Layer

An optional separate adhesive interface layer 36 may be provided. In the embodiment illustrated in FIG. 1, an interface layer 36 is situated intermediate the blocking layer 34 and the charge generator layer 38. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 36 may be applied directly to the hole blocking layer 34. Thus, the adhesive interface layer 36 in embodiments is in direct contiguous contact with both the underlying hole blocking layer 34 and the overlying charge generator layer 38 to enhance adhesion bonding to provide linkage. In yet other embodiments, the adhesive interface layer 36 is entirely omitted.

Any suitable solvent or solvent mixtures may be employed to form a coating solution of the polyester for the adhesive interface layer 36. Typical solvents include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 36 may have a thickness of from about 0.01 micrometers to about 900 micrometers after drying. In embodiments, the dried thickness is from about 0.03 micrometers to about 1 micrometer.

The Charge Generating Layer

The photogenerating layer, CGL 38 may thereafter be applied to the adhesive layer 36. Any suitable charge generating binder layer 38 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength from about 400 to about 900 nm during the imagewise radiation exposure step in an electrophotographic imaging process to forth an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the CGL 38, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ-400 (poly(4,4'-dihydroxy-diphenyl-1-1-cyclohexane) which has a $M_W$=40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The CGL 38 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Charge Transport Layer

The CTL 40 is thereafter applied over the charge generating layer 38 and may include any suitable transparent organic polymer or non-polymeric material capable of supporting the injection of photogenerated holes or electrons from the charge generating layer 38 and capable of allowing the transport of these holes/electrons through the CTL to selectively discharge the surface charge on the imaging member surface. In one embodiment, the CTL 40 not only serves to transport holes, but also protects the charge generating layer 38 from abrasion or chemical attack and may therefore extend the service life of the imaging member. The CTL 40 can be a substantially non-photoconductive material, but one which supports the injection of photogenerated holes from the charge generation layer 18. The layer 40 is normally transparent in a wavelength region in which the electrophotographic imaging member is to be used when exposure is effected therethrough to ensure that most of the incident radiation is utilized by the underlying charge generating layer 38. The CTL should exhibit excellent optical transparency with negligible light absorption and neither charge generation nor discharge if any, when exposed to a wavelength of light useful in xerography, e.g., 400 to 900 nanometers. In the case when the photoreceptor is prepared with the use of a transparent substrate 32 and also a transparent conductive layer 30, image wise exposure or erase may be accomplished through the substrate 32 with all light passing through the back side of the substrate. In this case, the materials of the layer 40 need not transmit light in the wavelength region of use if the charge generating layer 38 is sandwiched between the substrate and the CTL 40. The CTL 40 in conjunction with the charge generating layer 38 is an insulator to the extent that an electrostatic charge placed on the CTL is not conducted in the absence of illumination. The CTL 40 should trap minimal charges as the charge pass through it during the printing process.

The CTL 40 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 38 and capable of allowing the transport of these holes through the CTL 40 in order to discharge the surface charge on the CTL. The charge transport component typically comprises small molecules of an organic compound which cooperate to transport charge between molecules and ultimately to the surface of the CTL.

Any suitable inactive resin binder soluble in methylene chloride, chlorobenzene, or other suitable solvent may be employed in the CTL. Exemplary binders include polyesters, polyvinyl butyrals, polycarbonates, polystyrene, polyvinyl formals, and combinations thereof. The polymer binder used for the CTLs may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly(4,4'-isopropylidene diphenyl carbonate), poly(4,4'-diphenyl-1,1'-cyclohexane carbonate), and combinations thereof. The molecular weight of the binder can be for example, from about 20,000 to about 1,500,000. One exemplary binder of this type is a MAKROLON binder, which is available from Bayer AG and comprises poly(4,4'-isopropylidene diphenyl) carbonate having a weight average molecular weight of about 120,000.

Exemplary charge transport components include aromatic polyamines, such as aryl diamines and aryl triamines. Exemplary aromatic diamines include N,N'-diphenyl-N,N'-bis(alkylphenyl)-1,1'-biphenyl-4,4-diamines, such as mTBD, which has the formula (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N'-bis-(4-methylphenyl)-N,N-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde(diphenylhydrazone), as described, for example in U.S. Pat. Nos. 4,150,987, 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in layer 40 may be, for example, at least about 5 weight percent and may comprise up to about 60 weight percent. The concentration or composition of the charge transport component may vary through layer 40, as disclosed, for example, in U.S. Pat. Nos. 7,033,714; 6,933,089; and 7,018,756, the disclosures of which are incorporated herein by reference in their entireties.

In one exemplary embodiment, layer 40 comprises an average of about 10-60 weight percent N,N'-diphenyl-N,N'-bis(3-methylphenyl)-1,1'-biphenyl-4,4'-diamine, such as from about 30-50 weight percent N,N'-diphenyl-N,N'-bis(3-methylphenyl)-1,1'-biphenyl-4,4'-diamine.

The CTL 40 is an insulator to the extent that the electrostatic charge placed on the CTL is not conducted in the absence of illumination at a rate sufficient to prevent formation and retention of an electrostatic latent image thereon. In general, the ratio of the thickness of the CTL 40 to the charge generator layer 38 is maintained from about 2:1 to about 200:1 and in some instances as great as about 400:1.

Additional aspects relate to the inclusion in the CTL 40 of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present at about 10 weight percent based on the concentration of the charge transport component. Other suitable antioxidants are described, for example, in abovementioned U.S. Pat. No. 7,018,756, incorporated by reference.

In one specific embodiment, the CTL 40 is a solid solution including a charge transport component, such as N,N'-diphenyl-N,N'-bis(3-methylphenyl)-1,1'-biphenyl-4,4'-diamine, molecularly dissolved in a polycarbonate binder, the binder that is frequently being used is either a bisphenol A polycarbonate of poly(4,4'-isopropylidene diphenyl carbonate) or a bisphenol Z polycarbonate of poly(4,4'-diphenyl-1,1'-cyclohexane carbonate).

Bisphenol A is a chemical building block primarily used to make polycarbonate plastic and epoxy resins. The film forming bisphenol A polycarbonate, having a weight average molecular weight of from about 20,000 to about 130,000 is typically used as the CTL binder; it has a molecular structure formula shown below:

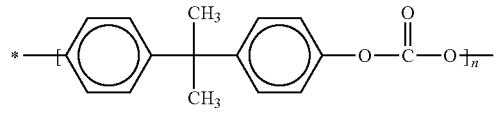

where n indicates the degree of polymerization. Alternatively, the bisphenol Z polycarbonate of poly(4,4'-diphenyl-1,1'-cyclohexane carbonate) may also be used to for binder the CTL formulation. The molecular structure of poly(4,4'-diphenyl-1,1'-cyclohexane carbonate), having a weight average molecular weight of about from about 20,000 to about 200,000, is given in the formula below:

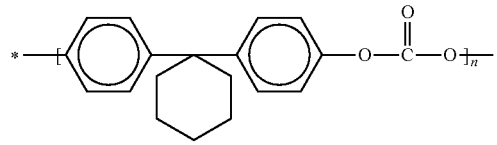

where n indicates the degree of polymerization.

The conventional CTL 40 may have a Young's Modulus in the range of from about $2.5\times10^{-5}$ psi ($1.7\times10^{-4}$ Kg/cm$^2$) to about $4.5\times10^{-5}$ psi ($3.2\times10^{-4}$ Kg/cm$^2$) and a thermal contraction coefficient of from about $6\times10^{-5}$/° C. to about $8\times10^{-5}$/° C.

The thickness of the CTL 40 can be from about 5 micrometers to about 200 micrometers and preferably from about 15 micrometers to about 40 micrometers. The CTL may comprise dual layers or multiple layers with different concentration of charge transporting components.

The Ground Strip Layer

Other layers such as conventional ground strip layer 41 is conveniently applied by co-coating process along with the application of CTL and adjacent to one edge of the imaging member. A typical ground strip layer 41 does include, for example, conductive particles dispersed in a film forming binder may be applied to one edge of the imaging member to promote electrical continuity with the conductive layer 30 through the hole blocking layer 34. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer may have a thickness from about 7 micrometers to about 42 micrometers, for example, from about 14 micrometers to about 23 micrometers.

The Anticurl Back Coating

Since the CTL 40 can have a substantial thermal contraction mismatch compared to that of the substrate support 32, the prepared flexible electrophotographic imaging member may exhibit spontaneous upward curling due to the result of larger dimensional contraction in the CTL than the substrate support 32, as the imaging member cools down from its Tg to room ambient temperature after the heating/drying processes of the applied wet CTL coating. An anti-curl back coating 33 can be applied to the back side of the substrate support 32 (which is the side opposite the side bearing the electrically active coating layers) in order to render the prepared imaging member with desired flatness.

Generally, anticurl back coating 33 comprises a polymer and an adhesion promoter dissolved in a solvent and coated on the reverse side of the active photoreceptor. The anticurl back coating must adhere well to the substrate 32, for example polyethylenenaphthalate (KADELEX) substrate, of the imaging member, for the entire duration of the functional life of the imaging member belt, while being subjected to xerographic cycling over rollers and backer bars within the copier or printer.

In a conventional anticurl back coating, film forming bisphenol A polycarbonate or bisphenol Z polycarbonate, same as the binder polymer used in the CTL 40, is also used for anticurl back coating preparation. To promote adhesion bonding to the substrate support 33, an adhesion promoter of copolyester is included in its material matrix to effect the anticurl back coating adhesion strength to the substrate support. Satisfactory adhesion promoter content is from about 0.2 percent to about 20 percent but preferably from about 2 percent to about 10 percent by weight, based on the total weight of the anticurl back coating The adhesion promoter may be any known in the art, such as for example, VITEL PE2200 which is available from Bostik, Inc. (Middleton, Mass.). VITEL PE2200 is a copolyester resin of terephthalic acid and isophthalic acid with ethylene glycol and dimethyl propanediol. A solvent such as methylene chloride may be used in embodiments. The anticurl back coating has a thickness of from about 5 micrometers to about 50 micrometers, but preferably from about 10 micrometers to about 20 micrometers, in further embodiments. A generic or conventional anticurl back coating formulation is a 92:8 ratio of polymer to adhesive dissolved at 9 percent by weight in a solvent. Specifically, the formulation may be 92:8 ratio of polcarbonate to VITEL PE2200 adhesive. The polycarbonate and adhesive promoter may both be dissolved at 9 percent by weight in a solvent of methylene chloride to give the anticurl back coating solution.

The flexible multilayered electrophotographic imaging member of an exemplified embodiment of the present disclosure is shown in FIG. 2. Although all the photoelectrically active layers 30, 32, 33, 34, 36, 38, 40, 41 in this imaging member are prepared and maintained to comprise of the very exact same compositions and dimensions as those described in FIG. 1, nonetheless the exception is that an overcoat layer 42 is added onto the CTL 40 to provide surface protection against chemical contaminant attack and improve mechanical function.

The Overcoat Layer

The aspect of this disclosure is related to the inclusion/addition of a physically/mechanically robust overcoat 42, over the CTL 40 of the imaging member, to render surface protection and extend functional life in the field. Therefore, the overcoat layer 42 thus prepared according to the present formulation disclosure is intended to impact effective protection for the CTL against abrasion/scratch/wear failures as a result of constant mechanical interaction against cleaning blade, cleaning brush, dirt debris, carrier beads from developer, and loose $CaCO_3$ particles from paper; most importantly, the elimination of chemical amine attack from preprinted papers that exacerbates the early onset of print quality failure and prevents the imaging member belt from reaching its service life target.

In example of one specific embodiment, the electrophotographic imaging member has an added-on overcoat layer 42 of the present formulated to comprise a novel film forming A-B diblock copolymer. The copolymer overcoat layer disposed on the CTL is created by modifying the bisphenol A polycarbonate poly(4,4'-isopropylidene diphenyl carbonate) to include a phthalic acid containing segmental block at the terminal of bisphenol A polycarbonate back bone. Therefore, the A-B di-block copolymer comprising two segmental blocks, with the first segment block (A) being:

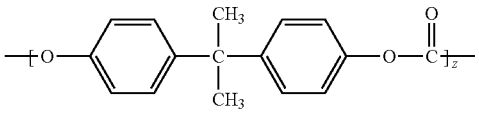

Block (A)

and the second segment block (B) being:

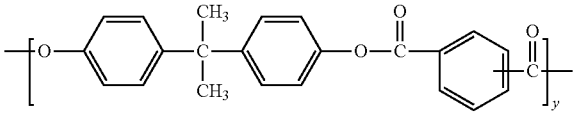

Block (B)

As such, the A-B diblock copolymer comprises a bisphenol A polycarbonate segment block A which is linking to a phthalic acid-containing segment block B, and has a general molecular structure shown in Formula (I) below:

Formula (I)

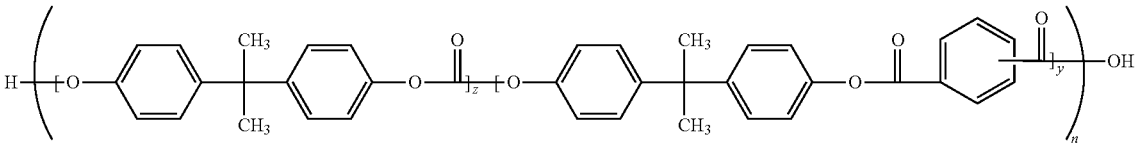

Block (A) Block (B)

In another specific embodiment, the disclosed overcoat layer 42 of the electrophotographic imaging member is also formulated to comprise a similar film forming A-B diblock copolymer comprising bisphenol A polycarbonate poly(4,4'-isopropylidene diphenyl carbonate) block A and a phthalic acid containing segmental block B at the terminal of bisphenol A polycarbonate back bone. The similar A-B diblock copolymer of the bisphenol A polycarbonate has a general molecular structure shown in the following Formula (II):

Formula (II)

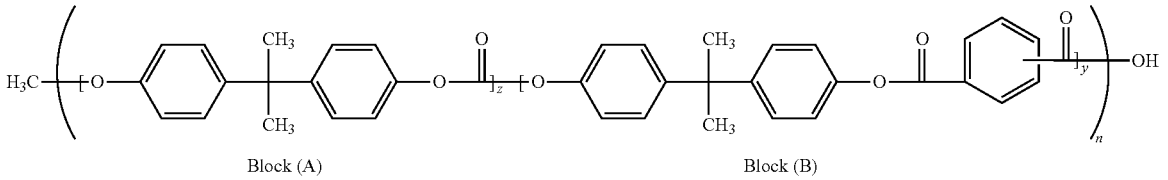

In the above Formulas (I) and (II), z represents the number of bisphenol A repeating units in block A of from about 9 to about 18, y is number of repeating phthalic acid block B of from about 1 to about 2, and n is the degree of polymerization. The degree of polymerization, n, is between about 20 and about 80 of the diblock copolymer having molecular weight between about 100,000 and about 200,000.

The film forming A-B diblock copolymer, derived and modified from a bisphenol A polycarbonate, is a variance of the bisphenol A polycarbonate which includes small fraction of phthalic acid such that the resulting copolymer contains about 90 mole percent of a bisphenol A segment block A linearly linking to about 10 mole percent of a segmental block B of phthalic acid terminal in the A-B diblock copolymer chain. The phthalic acid terminal in the A-B diblock copolymer molecule of both Formulas (I) and (II) may either be a terephthalic acid or an isophthalic acid represented by the following, respectively:

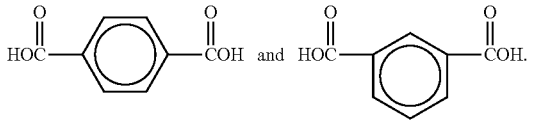

The specific A-B diblock copolymer chosen to meet the present flexible imaging member overcoating layer disclosure formulation requirement is LEXAN HLX polymer, as described in the above Formulas (I) and (II) and available from Sabic Innovative Plastics (Pittsfield, Mass.). Since the LEXAN HLX is a film forming and optically clear polycarbonate/phthalic acid copolymer and has the physical/mechanical/thermal properties equivalent to those of the conventional polycarbonate counterpart used as CTL binder in prior art the imaging members, so utilization of it for overcoat layer formulation does produce good fusion bonding the CTL to thereby eliminating the possibility of layer delamination. The key benefit of choosing LEXAN HLX polymer for overcoating application, is based on the capability of the phthalic acid terminal to provide amine species quenching/neutralization effect for absolute elimination of the root cause of copy ghosting defects printout problem.

In the extended embodiments of this disclosure shown in FIG. 2, the bisphenol A segmental block (A) of the film forming A-B di-block copolymer of Formulas (I) and (II) used for overcoat layer formulation may alternatively include each of the other types of bisphenol carbonates selected from the group consisting of:

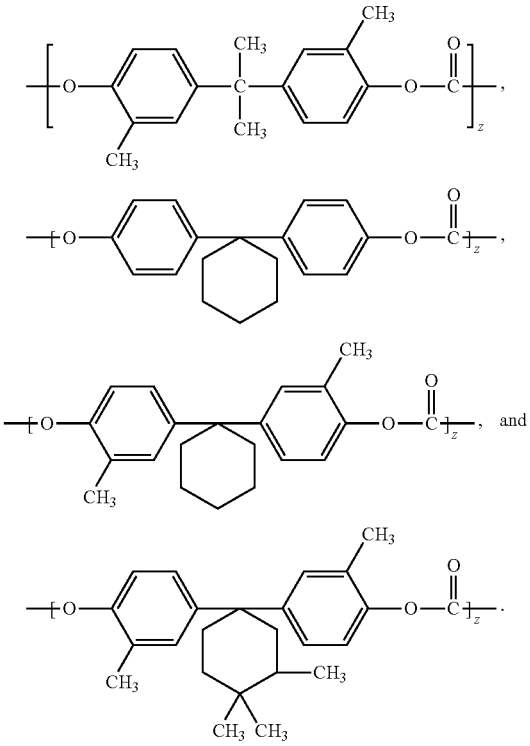

The phthalic acid containing block B linkage is selected from one consisting of:

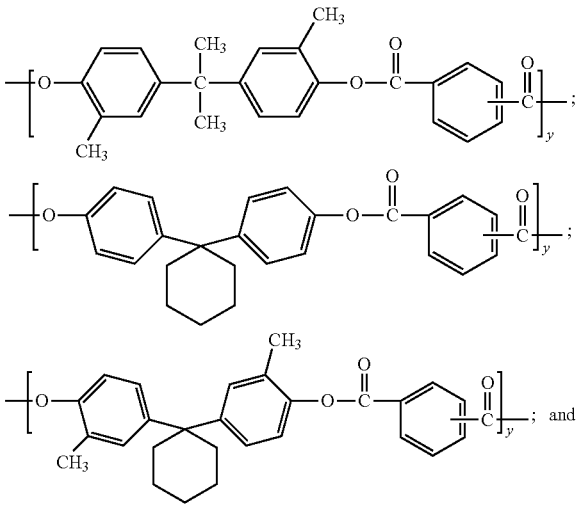

-continued

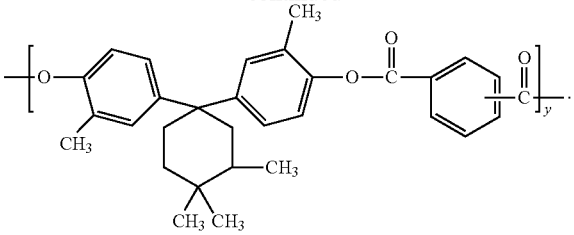

Additionally, the block (B) phthalic acid containing terminal in the A-B diblock copolymers (having all the alternative structures described above) may be a terephthalic acid or an isophthalic acid represented by the following, respectively:

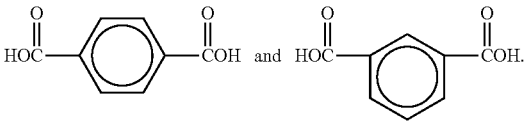

Furthermore, the phthalic acid terminal may alternatively be replaced with an adipic acid or an azelaic acid shown by the following, respectively:

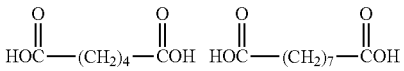

As an alternative to the two discretely separated CTL 40 and CGL 38, a single imaging layer 22 having both charge generating and charge transporting capability may be employed for their substitution, as shown in FIG. 3, with other layers of the imaging member being formed as described above, but plus the inclusion of an overcoat layer 42 of this disclosure. The imaging layer 22 is formed to comprise only one single electrophotographically active layer capable of retaining an electrostatic charge in the dark during electrostatic charging, imagewise exposure and image development, as disclosed, for example, in U.S. Pat. No. 6,756,169. The single imaging layer 22 may include charge transport molecules in a binder, similar to those of the CTL 40 and optionally may also include a photogenerating/photoconductive material, similar to those of the CGL 38 described above. In this very embodiment of FIG. 3, the flexible imaging member of this disclosure is provided with an overcoat 42, prepared to comprise the very exact same formulation as described in the preceding, is included to enhance physical/function and provide chemical contaminant protection over the imaging layer 22 for service life extensions.

The overcoat layer 42 of the present disclosure may comprise about 0 to about 10 percent by weight of a charge transport compound; but is preferably to comprise from about 1 to about 5 percent by weight charge transport compound based on the total weight of the overcoat. The overcoat is from about 1 to about 10 micrometers in thickness, and preferred to be from about 2 to about 4 micrometers in thickness. The formulation of the present disclosed overcoat layer is equally applicable as a protective overcoating for multilayered electrophotographic imaging members of rigid drum design and also acceptable for both flexible and rigid drum electrographic imaging member application.

In all the flexible multilayered electrophotographic imaging members embodiments disclosed above, the overcoat layer 42, may also contain inorganic, organic, or inorganic/organic hybrid fillers (from about 2 to about 10 weight percent based on the total weight of the resulting overcoat) to impart further wear resistant enhancement. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used as fillers to achieve mechanical property reinforcement.

In further additional embodiments, hybrid inorganic/organic Polyhedral Oligomeric Silsesquioxane (POSS) nanoparticle dispersion may also be used for incorporation into the overcoat layer 42 to impact maximum mechanical performance. Typical POSS nano-particles that can be used, in embodiments, for overcoat layer dispersion may be selected from one of the following species for maximizing the surface energy lowering effect and abrasion/wear resistance enhancement of the overcoat layer: poly(dimethyl-co-methylhydrido-co-methylpropylPOSS)siloxane, fluoro(13)disilanolisobutyl-POSS, poly(dimethyl-co-methylvinyl-co-methylethylsiloxyPOSS)siloxane, trisfluoro(13)cyclopentyl-POSS, and fluoro(13)disilanolcyclopentyl-POSS. In alternative flexible imaging member embodiments, other POSS nano-particles which are applicable for the disclosed overcoat layer preparation may also include the following: phenylisooctyl-POSS, trisilanolphenyl-POSS, cyclohexenyl-POSS, and poly(styrylPOSS-co-styrene).

The process of this disclosure for fabricating the flexible multilayered electrophotographic imaging member webs described in all the above embodiments comprise providing a substrate layer having a first side and a second side, and at least a first parallel side and a second parallel side. The substrate may further include a conducting layer. The process includes forming at least one imaging layer on the first side of the substrate, forming an overcoat layer of the present disclosure over the at least one imaging layer, and then forming an anticurl back coating on the second side of the substrate to render the imaging member desired flatness. Additionally, there may also be included steps and process for forming the disclosure overcoat layer on the at least one imaging layer, as well as for forming an optional ground strip layer on the at least one imaging layer.

The multilayered, flexible multilayered electrophotographic imaging member web stocks fabricated in accordance with the embodiments described herein may be cut into rectangular sheets. Each cut sheet is then brought overlapped at ends thereof and joined by any suitable means, such as ultrasonic welding, gluing, taping, stapling, or pressure and heat fusing to form a continuous imaging member seamed belt, sleeve, or cylinder.

The overcoated flexible imaging member belt thus prepared may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

The flexible electrophotographic imaging member can be evaluated by printing in a marking engine into which a photoreceptor belt formed according to any of these exemplary embodiments has been installed. For the intrinsic electrical properties, it can also be investigated by mounting imaging member sample(s) on a conventional electrical drum scanner. Alternatively, the impact on charge deficient spots development propensity or suppression can also be evaluated using electrical techniques, such as those disclosed in U.S. Pat. Nos. 5,703,487; 5,697,024; 6,008,653; 6,119,536; 6,150,824 and 5,703,487, which are incorporated herein in their entireties by reference.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

Control Imaging Member Preparation Example

A conventional prior art flexible electrophotographic imaging member web was prepared by providing a 0.02 micrometer thick titanium layer coated substrate of a biaxially oriented polyethylene naphthalate substrate (PEN, available as KADALEX from DuPont Teijin Films.) having a thickness of 4.2 mils. The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a CGL. The charge generating layer dispersion was prepared by adding 0.45 gram of IUPILON 200, a polycarbonate of poly(4,4'-diphenyl)-1,1'-cyclohexane carbonate (PCZ 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This CGL comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web was simultaneously coated over with a charge transport layer (CTL) and a ground strip layer by co-extrusion of the coating materials. The CTL was prepared by introducing into an amber glass bottle in a weight ratio of 1:1 (or 50 weight percent of each) of a bisphenol A polycarbonate thermoplastic (FPC 0170, having a molecular weight of about 120,000 and commercially available from Mitsubishi Chemicals) and a charge transport compound of N,N'-diphenyl-N,N'-bis(3-methylphenyl)-1,1'-biphenyl-4,4'-diamine.

The resulting mixture was dissolved to give 15 percent by weight percent solid in methylene chloride and then added into which with 1.35 weight percent of plasticizing liquid diethyl phthalate to give the final CTL coating solution. This solution was then applied on the CGL by extrusion to form a coating which after drying in a forced air oven gave a 29 micrometers thick plasticized dry CTL comprising 50:50 weight ratio of diamine transport charge transport compound to FPC0170 bisphenol A polycarbonate binder and 8 weight percent diethyl phthalate plasticizer.

The strip, about 10 millimeters wide, of the adhesive layer left uncoated by the charge generator layer, was coated with a ground strip layer during the co-extrusion process. The ground strip layer coating mixture was prepared by combining 23.81 grams of polycarbonate resin (FPC 0170, available from Mitsubishi Chemical Corp. (Tokyo, Japan)) having 7.87 percent by total weight solids and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (ACHESON Graphite dispersion RW22790, available from Acheson Colloids Company (Port Huron, Mich.)) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web containing all of the above layers was then passed through 125° C. a forced air oven to dry the co-extrusion coated ground strip and plasticized CTL simultaneously to give respective 19 micrometers and 29 micrometers in dried thicknesses. The flexible imaging member thus obtained was used to serve as a control.

Example 2

Disclosure Imaging Member Preparation Example

A flexible electrophotographic imaging member web of the present disclosure was then prepared, using the very exact same materials and following the same procedures as those described in the Control Imaging Member Preparation Example above, except that the top exposed CTL was solution coated onto with a protective A-B diblock copolymer. The specific A-B diblock copolymer chosen to meet the present flexible imaging member overcoating layer disclosure formulation requirement is LEXAN HLX copolymer, it had a molecular weight about 115,000 and was available from Sabic Innovative Plastics (Pittsfield, Mass.). After drying at 120° C., the applied wet coating gave a 3-micrometer dried overcoat layer thickness. The molecular structures of LEXAN HLX copolymer is given in Formulas (I) and (II) below:

Formula (I)

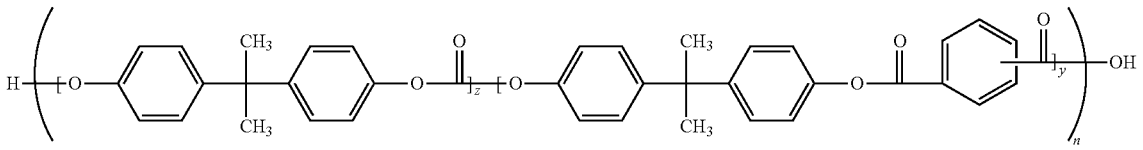

Formula (II)

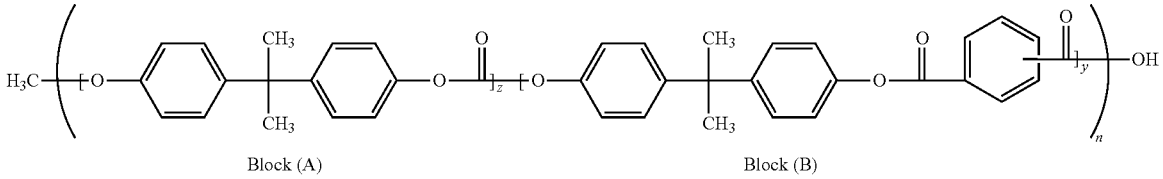

In these formulas, z represents the number of bisphenol A repeating units in block A of about 9 (or 90 mole percent); y is the number of repeating phthalic acid block B of about 1 (or 10 mole percent) and n is the degree of polymerization. The degree of polymerization, n, is about 20 for the diblock copolymer having a molecular weight of about 115,000 for LEXAN HLX copolymer (available from Sabic Innovative Plastics).

Mechanical and Photo-Electrical Evaluations

The flexible imaging members prepared to have an added protective overcoat according to the Disclosure Example and the Control Example were assessed for each respective mechanical/photoelectrical properties.

For surface scratch resistance determination, all these imaging members were investigated by utilizing a stylus surface scratching test method. In brief, each imaging member was laid down (with the top surface facing upwardly) on a flat platform, a stainless steel phonographic needle under a control 6-gram load was then sliding over the member surface at a constant speed of 4 inches/min to induce a surface scratch. Both tested P/R imaging members were analyzed by Transmission electron microscopy (TEM) cross-sectioning to assess each respective scratch induced surface damage to find that the overcoat layer of present disclosure was twice more scratch resisting to the stylus indentation/sliding damage than the plasticized CTL of the control Example. The mechanical scratch resistance enhancement seen for the overcoat layer was due to the fact that no charge transport compound N,N'-diphenyl-N,N'-bis(3-methylphenyl)-1,1'-biphenyl-4,4'-diamine was included into the layer as compared to the CTL control which was formulated to comprise three components, consisting of 50 weight percent charge transport compound N,N'-diphenyl-N,N'-bis(3-methylphenyl)-1,1'-biphenyl-4,4'-diamine, 8 weight percent plasticizing liquid diethyl phthalate, and 50 weight percent polycarbonate binder; therefore, the CTL control as prepared had much less polymer chains present in per unit volume of the CTL matrix than that (about 58% lesser) in the overcoat layer of this disclosure.

The photoelectrical properties of the above mentioned imaging members were further determined by using the 4000 scanner. The measurement results thus obtained (shown in Table 1 below) have indicated that imaging members prepared to include the A-B diblock copolymer overcoat layer, utilized for achieving mechanical function improvement and protection against chemical contaminant, did not cause any adverse changes to photoelectrical integrity of the imaging member of the Control Example.

TABLE 1

| Imaging Member ID | Vo (V) | S (V) | Vc (V) | Vr (V) | Vdd (V) |
|---|---|---|---|---|---|
| Control Member | 800 | 360 | 163 | 46 | 29 |
| With LEXAN HLX Overcoat Layer | 800 | 371 | 172 | 50 | 27 |
| After 10K Cycles | | | | | |
| Control Member | 800 | 358 | 243 | 71 | 19 |
| With LEXAN HLX Overcoat Layer | 800 | 365 | 148 | 73 | 17 |

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising:

a substrate;

a charge generating layer disposed on the substrate;

at least one charge transport layer disposed on the charge generating layer; and an overcoat layer disposed on the charge transport layer, wherein the overcoat layer comprises a film forming and optically clear A-B diblock copolymer capable of providing protection against amine species contaminants, wherein the diblock copolymer has a formula selected from the group consisting of

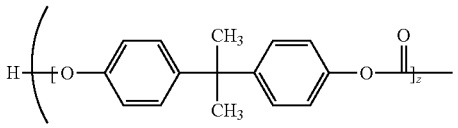

Block (A)

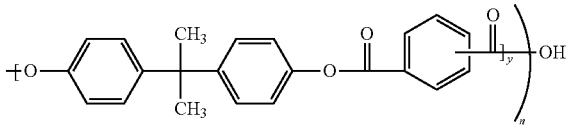

Block (B)

wherein z representing the number of bisphenol A repeating units in block A is from about 9 to about 18, y representing the number of repeating phthalic acid in block B is from about 1 to about 2, and n representing the degree of polymerization of diblock copolymer is from about 20 to about 80; and

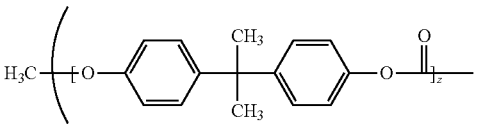

Block (A)

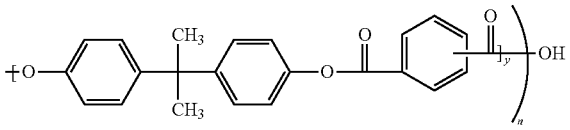

Block (B)

wherein z representing the number of bisphenol A repeating units in block (A) is from about 9 to about 18, y representing the number of repeating phthalic acid in block (B) is from about 1 to about 2, and n representing the degree of polymerization of diblock copolymer is from about 20 to about 80; and mixtures thereof.

2. The imaging member of claim 1, wherein the diblock copolymer has a molecular weight of from about 100,000 to about 200,000.

3. The imaging member of claim 1, wherein the diblock copolymer is present in an amount of from about 90 to about 100 percent by weight based on the total weight of the overcoat layer.

4. The imaging member of claim 3, wherein the overcoat layer further comprises a charge transport compound present in an amount of from about 0 to about 10 percent by weight based on the total weight of the overcoat layer.

5. The imaging member of claim 4, wherein the overcoat layer further comprises a charge transport compound present in an amount of from about 1 to about 5 percent by weight based on the total weight of the overcoat layer.

6. The imaging member of claim 1, wherein the overcoat layer has a thickness of from about 1 to about 10 micrometers.

7. The imaging member of claim 6, wherein the overcoat layer has a thickness of from about 2 to about 4 micrometers.

8. The imaging member of claim 1, wherein the overcoat layer further comprises organic fillers, inorganic fillers, or a hybrid of organic/inorganic fillers in an amount of from about 2 to about 10 weight percent based on the total weight of the overcoat layer.

9. The imaging member of claim 8, wherein the inorganic fillers are selected from the group consisting of silica, metal oxides, metal carbonate, metal silicates, and mixtures thereof, and the organic fillers are selected from the group consisting of polytetrafluoroethylene (PTFE), stearates, fluorocarbon (PTFE) polymers, waxy polyethylene, fatty amides, and mixtures thereof.

10. The imaging member of claim 8, wherein the overcoat layer further comprises a hybrid inorganic/organic Polyhedral Oligomeric Silsesquioxane (POSS) nano-particle dispersion.

11. The imaging member of claim 1, wherein the bisphenol polycarbonate is selected from the group consisting of

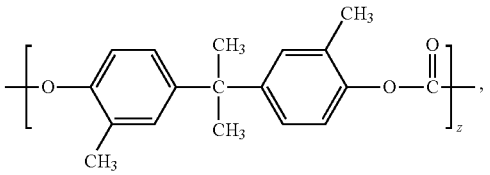

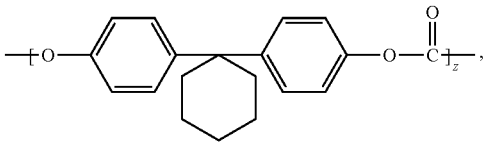

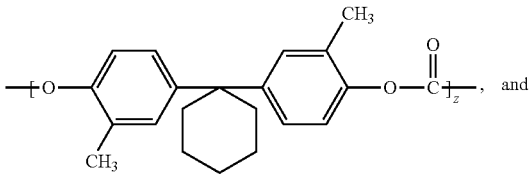

and

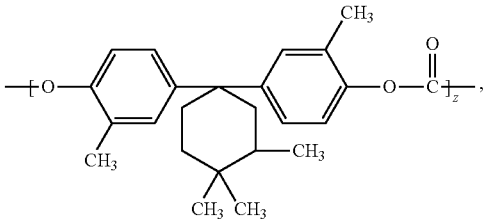

wherein z represents the number of repeating units of from about 9 to about 18.

12. The imaging member of claim 1, wherein the organic acid is selected from the group consisting of phthalic acid, terephthalic acid, isophthalic acid, adipic acid, azelaic acid, and mixtures thereof.

13. The imaging member of claim 1, wherein the A-B diblock copolymer contains about 90 mole percent of a bisphenol A segment block (A) linearly linking to about 10 mole percent of a segmental block (B) of phthalic acid terminal in the A-B diblock copolymer chain.

14. The imaging member of claim 1, wherein the charge generation layer and the charge transport layer are combined into a single imaging layer.

15. An imaging member comprising:

a substrate;

a charge generating layer disposed on the substrate;

at least one charge transport layer disposed on the charge generating layer; and an overcoat layer disposed on the charge transport layer, wherein the overcoat layer comprises a film forming and optically clear A-B diblock copolymer comprising two segmental blocks of a bisphenol A polycarbonate ($C_{16}H_{14}O_3$) and a phthalic acid, wherein block A comprises bisphenol A, block A having about 9 to about 18 repeating units, and block B comprises phthalic acid, block B having about 1 to about 2 repeating units.

16. An image forming apparatus for forming images on a recording medium comprising:

a) an imaging member having a charge retentive-surface for receiving an electrostatic latent image thereon, wherein the imaging member comprises a substrate;

a charge generating layer disposed on the substrate;

at least one charge transport layer disposed on the charge generating layer; and an overcoat layer disposed on the charge transport layer, wherein the overcoat layer comprises a film forming and optically clear A-B diblock copolymer capable of providing protection against amine species contaminants, wherein the diblock copolymer has a formula selected from the group consisting of

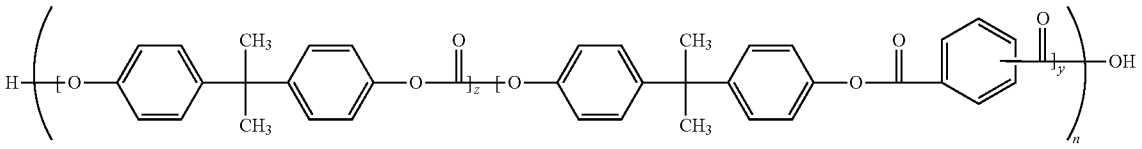

Block (A) Block (B)

wherein z representing the number of bisphenol A repeating units in block A is from about 9 to about 18, y representing the number of repeating phthalic acid in block B is from about 1 to about 2, and n representing the degree of polymerization of diblock copolymer is from about 20 to about 80; and

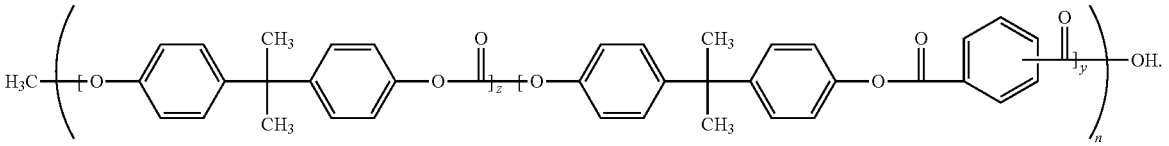

Block (A) Block (B)

wherein z representing the number of bisphenol A repeating units in block (A) is from about 9 to about 18, y representing the number of repeating phthalic acid in block (B) is from about 1 to about 2, and n representing the degree of polymerization of diblock copolymer is from about 20 to about 80; and mixtures thereof;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

17. The image forming apparatus of claim 16, wherein the overcoat layer further comprises a charge transport compound present in an amount of from about 0 to about 10 percent by weight based on the total weight of the overcoat layer.

18. The image forming apparatus of claim 16, wherein the overcoat layer has a thickness of from about 1 to about 10 micrometers.

* * * * *